2/17/87 OR 4,643,736

United States Patent [19]

Cholley

[11] Patent Number: 4,643,736

[45] Date of Patent: Feb. 17, 1987

[54] DESIZING AND BLEACHING WOVEN FABRICS IN A SINGLE OPERATION IN A BATH BASED ON SODIUM CHLORITE

[75] Inventor: Jean-Marie Cholley, Paris, France

[73] Assignee: Produits Chimiques Ugine Kuhlmann, France

[21] Appl. No.: 731,591

[22] Filed: May 6, 1985

Related U.S. Application Data

[63] Continuation of Ser. No. 552,861, Nov. 17, 1983, abandoned, which is a continuation of Ser. No. 336,883, Jan. 4, 1982, abandoned.

[30] Foreign Application Priority Data

Jan. 23, 1981 [FR] France ..... 81 01201

[51] Int. Cl.[4] ..... D06L 3/06

[52] U.S. Cl. ..... 8/108.1; 8/138

[58] Field of Search ..... 8/108, 138

[56] References Cited

U.S. PATENT DOCUMENTS

| | | | |
|---|---|---|---|
| 2,974,001 | 3/1961 | Windbichler et al. | 8/108 |
| 3,083,072 | 3/1963 | Leclerc | 8/108 |

FOREIGN PATENT DOCUMENTS

| | | | |
|---|---|---|---|
| 670613 | 9/1963 | Canada | 8/138 |
| 1267656 | 5/1968 | Fed. Rep. of Germany | 8/138 |

OTHER PUBLICATIONS

G. Vernin "Les Enzymes Organoleptiques Immobilisées " Informations Chimie No. 224, Apr. 1982, pp. 171–184.

Kirk–Othmer, *Encyclopedia of Chemical Technology*, 1964 and 1969, vol. 3, p. 555.

*Primary Examiner*—Paul Lieberman
*Assistant Examiner*—John F. McNally
*Attorney, Agent, or Firm*—Brooks Haidt Haffner & Delahunty

[57] ABSTRACT

Processes for desizing and bleaching fabrics in a single operation in a bath comprising sodium chlorite and a base such as sodium hydroxide, desirably together with an activating agent, an enzyme preparation based on a starch-degrading enzyme, and a surfactant, the processes affording substantial savings in water, steam, labor and investment costs.

7 Claims, No Drawings

DESIZING AND BLEACHING WOVEN FABRICS IN A SINGLE OPERATION IN A BATH BASED ON SODIUM CHLORITE

This application is a continuation of application Ser. No. 552,861, filed Nov. 17, 1983, now abandoned, which is a continuation of application Ser. No. 336,883, filed Jan. 4, 1982, now abandoned.

BACKGROUND OF THE INVENTION

This invention relates to processes for treating textiles, and more particularly, it relates to processes for desizing and bleaching woven fabrics or similar goods based on textile fibers, in a single operation.

It is known that the preparation of fabrics made of cellulose fibers, by dyeing, printing and other finishing treatments, generally comprises the operations of desizing, boiling off, bleaching, and optionally mercerizing. The purpose of desizing is to eliminate the sizing products previously applied to the warp threads to improve their characteristics on the loom, as well as any products which may have been applied to the weft threads.

The sizing products applied to the threads before weaving may be based either on starch dispersions alone or in admixture with starches which have been more or less converted chemically, or on derivatives of polyvinyl alcohol, or polyacrylate derivatives or etherified cellulose. The sizing products may be retained to a greater or lesser extent in the fabric, depending on the drying temperature, the twisting of the threads and the texture of the fabric.

The presence of such sizes makes it impossible to obtain a uniform, solid shade during dyeing and printing with many dyes, and such sizes have to be eliminated before the dyeing or printing operations can be effected. For some fabrics intended for white sales, the removal of the size is also desirable to ensure that the treated goods are pleasant and supple to the touch. Desizing is generally effected by impregnation in an enzyme and surfactant bath heated to a temperature of between 60° C. and 75° C. The impregnated fabric may either be left to stand, or it may be steamed at a temperature of 100° C. It is then washed at 95° C., then at 60° C. and optionally in running water.

Boiling off, which is designed to saponify the greases in the cotton and solubilize the ligneous residues, is effected in a caustic soda medium at a temperature of between 100° C. and 140° C.

The purpose of bleaching is to oxidize the impurities which are a part of the unbleached or previously boiled off cotton, linen or other cellulose fiber. In virtually every case, it is carried out with oxidizing agents such as hydrogen peroxide, alkali peroxides and per-salts, peracetic acid, sodium hypochlorite, sodium chlorite, and the like.

The operations of desizing, boiling off and bleaching are generally carried out in an aqueous medium, with heat. Each operation is followed by hot and cold washes, resulting in considerable water and energy consumption.

THE INVENTION

The aim of the present invention is to reduce the number of operations for the preparation of fabric based on cellulose fibers, either alone or mixed with one another or with other regenerated or chemical fibers, such as viscoses, polyamides and polyesters, and the invention provides new processes wherein desizing and bleaching are combined in a single operation.

In brief, the processes of desizing and bleaching in a single operation according to the present invention are carried out in an aqueous bath containing sodium chlorite, a strong base such as an alkali metal hydroxide, and in certain desirable embodiments, an activating agent, an enzymic preparation based on starch-degrading enzyme, and a surface active agent.

An enzymatic preparation suitable for use according to the present invention is, for example, that shown in German Patent Application No. P 29 09 396.7. It consists of an intimate mixture of a starch-degrading enzyme, such as amylase, and a non-ionic surfactant belonging to the group composed of alkyl and alkaryl oxalkylates in water. An appropriate enzymatic composition is, for example, composed of 10 to 40 parts of aqueous enzymatic preparation and 10 to 60 parts of a non-ionic surfactant. Particularly good results are obtained when using one of these enzymatic preparations sold under the name Enzylase C by Messrs. Diamalt.

The process is desirably carried out as follows:

(1) Impregnating the fabric in the desizing and bleaching bath and squeezing out, so as to leave only the quantity of liquor necessary for the reaction in the fabric. This is generally between 60 and 120% of the weight of dry fabric, depending on the fabric in question.

(2) Steaming, to bring the fabric to the desired reaction temperature, generally between 20° and 120° C.

(3) Holding by rolling up or pleating the cloth in a J-Box, U-Box, carpet machine, or the like, for a period which can be varied from a few minutes to several hours.

The treatment is followed by successive washes at 90°-95° C., 60° C., and cold. The washing bath at 90°-95° C. can in certain embodiments advantageously contain added alkaline components, caustic soda, sodium carbonate, trisodium phosphate, and surface-active detergents.

One of the advantages of the process according to the present invention is that it does away with a wet desizing operation carried out at a minimum temperature of 60°-65° C., and several washing baths at temperatures of 90°-95° C.

The use of the process also does away with a "wet on wet" impregnation, that is, wet fabric being put into a bath containing the bleaching products. It is recognized that this treatment involves a number of operations, namely, preparation of a more concentrated bath and maintaining the impregnation bath at a constant level and concentration, all of which require either manual checking or automatic adjustment. To avoid "wet on wet" impregnation, some users adopt the procedure of an intermediate passage over a drying tenter, which involves the use of expensive equipment and a substantial energy consumption, particularly for heat.

The use of the process according to the invention therefore results in major savings in water, steam, labor and investment costs.

The characteristics of the fabric thus treated are excellent. They have a high degree of whiteness, virtually total elimination of the size, instant hydrophilism, and a satisfactory degree of polymerization.

All parts, percentages, proportions, and ratios herein are by weight, unless otherwise indicated.

The following examples are given to illustrate embodiments of the invention as it is presently preferred to practice it. It will be understood that these examples are illustrative, and the invention is not to be considered as restricted thereto except as indicated in the appended claims.

EXAMPLE I

A rough cotton fabric weighing 138 g/m$^2$, having a 150 cm width; reflectance 49.6% as measured with a Zeiss Elrepho reflectometer, No. 8 filter, at wavelength 457 nm; size content, 7.85%; and starch content 4%; intended to be printed with reactive dyes, is impregnated directly after being woven, in a bath containing:

| Ingredient | Amount |
|---|---|
| Sodium chlorite (25 percent) | 80 mL/L |
| Activating agent UG 45 | 15 g/L |
| Enzylase C | 10 g/L |
| Ukanil 1036, detergent wetting agent | 0.5 mL/L |

Sodium hydroxide is added to give a pH of 9.2–9.5.

The fabric is impregnated with 106 percent of its own weight of the foregoing bath and is heated to 95° C. by steaming.

It is rolled up in a heat-insulated chamber, where it continues to react at 95° C. for 1 hour 30 minutes.

After this time, it is unrolled and rinsed continuously in a series of vats. The first contains water heated to 95° C.; the second, heated to 95° C., contains water and 3–5 g/L sodium carbonate; the third contains water at 60° C.; and the fourth contains cold water. After drying, the fabric has the following characteristics:

| | |
|---|---|
| Reflectance (Zeiss Elrepho) | 82.8% |
| Residual starch content | 0.16% |
| Hydrophilicity | Instantaneous |

EXAMPLE II

A particularly grey and rough basket-weave cotton fabric which normally requires a desizing treatment and two bleaching treatments is singed and then subjected to desizing and bleaching, in a single operation.

The fabric, 150 cm wide, weighing 180 g per m$^2$, has a reflectance of 49.5% and a starch content of 7.25%. It is impregnated in a bath containing:

| Ingredient | Amount |
|---|---|
| Sodium chlorite (25 percent) | 90 mL/L |
| Activating agent UG 45 | 18 g/L |
| Enzylase C | 10 g/L |
| Ukanil 1036 | 1 mL/L |

Sodium hydroxide is added to give a pH of 9.2–9.5.

The fabric is moved at a speed of 70 meters per minute and picks up 94.5 percent of its own weight of the bath. It is heated to 85° C. by passing it into a steamer and is then rolled up in an insulated chamber.

After 2½ hours' reaction at 85° C., it is unrolled and then washed continuously under the conditions described in Example I.

After drying, the bleached fabric has the following characteristics:

| | |
|---|---|
| Reflectance (Elrepho) | 80.1% |

-continued

| | |
|---|---|
| Residual starch content | 0.18% |

Subsequent dyeing with reactive dyes gives excellent results.

EXAMPLE III

A Hacabah cotton fabric, unbleached reflectance 52.8%, starch content 6.60%, is treated, immediately after being woven, in a bath containing:

| Ingredient | Amount |
|---|---|
| Sodium chlorite (as 100 percent $NaClO_2$) | 27 g/L |
| Activating agent UG 45 | 14 g/L |
| Enzylase C | 10 g/L |
| Ukanil 1036 | 0.5 mL/L |

Sodium hydroxide is added to adjust the pH to 9.2–9.5.

The fabric, travelling at a rate of 85 meters per minute, is impregnated with 102 percent of its weight of bath after steaming at 95°–98° C. It is kept rolled up for two hours at a temperature of 90°–92° C. It is then subjected to washes at 90° C., with the addition of sodium carbonate at 60° C., and with cold water.

After drying, the bleached fabric has the following characteristics:

| | |
|---|---|
| Reflectance | 77% |
| Residual starch content | 0.15% |
| Hydrophilicity | Instantaneous |

By contrast, the usual treatment involves desizing by impregnation in a bath heated to 65° C., then leaving in a heat-insulated chamber. Thereafter, the conventional treatment involves washing at 95° C.–60° C. and with cold water, drying on a tenter, and then bleaching by impregnation. This is followed by steaming at 95° C. and storage at 85° C. for 2½ hours, washes at 95° C.–60° C., and a cold wash.

EXAMPLE IV

A cream linen-cotton mixture, with unbleached cotton warp threads and cream linen weft, 230 cm wide, weighing 525 g per m$^2$, starch content 5.70%, is singed then treated as follows:

Impregnation in a bath containing, per 800 liters:

| | |
|---|---|
| Sodium chlorite (25%) | 105 L |
| Activating agent UG 45 | 18.4 kg |
| Enzylase C | 8.0 kg |
| Ukanil 1036 | 1.6 L |

Sodium hydroxide is added to give a pH of 9.2–9.5.

The linen/cotton mixture, impregnated at a speed of 40–45 meters/minute, picks up 75% of its weight in the bath, passes into a steamer heated to 90° C. and is then left rolled up in a chamber maintained at 85°–90° C. for three hours.

It is then washed at 90 meters/minute under conditions analogous to those described above.

After drying, the fabric has the following characteristics:

| | |
|---|---|
| Reflectance | 79% |
| Residual starch content | 0.56% |
| Hydrophilicity | Instantaneous |

EXAMPLE V

A 65/35 polyester/cotton poplin, weight 130 g/m$^2$, unbleached reflectance 69.4%, is impregnated at 98% with its own weight of:

| Ingredient | Amount |
|---|---|
| Sodium chlorite, (25%) | 33 mL/L |
| Activating agent UG 45 | 7 g/L |
| Enzylase C | 10 g/L |
| Ukanil 1036 | 0.5 mL/L |

Sodium hydroxide is added to give a pH of 9.2–9.5.

The fabric is steamed at 98° C., then kept at this temperature for 1½ hours. It is then washed in water at 95° C. containing 3 g/L of $Na_2CO_3$, then in water at 60° C., and finally in cold water.

After drying, the bleached fabric has the following characteristics:

| | |
|---|---|
| Reflectance | 83.2% |
| Residual starch content | 0% |
| Hydrophilicity | Instantaneous |

EXAMPLE VI

A cotton sheet fabric intended to be printed, width 240 cm, weight 318 g per running meter, reflectance 59.4%, and starch content 7.82% of the weight of the fabric, is treated in a bath containing:

| Ingredient | Amount |
|---|---|
| Enzylase C | 10 g/L |
| Ukanil 1036 | 0.5 mL/L |

The bath is heated to 100° C. for 55 minutes, then cooled to 70° C., and the following are added:

| Ingredient | Amount |
|---|---|
| Sodium chlorite (25%, expressed as 100% $NaClO_2$) | 3 g/L |
| Activating agent UG 45 | 1.2 g/L |
| Formic acid | to provide pH 4 |

This is heated for 30 minutes to 100° C. and maintained at 100° C. for 30 minutes. The fabric is drained, then rinsed hot and cold, and dried on a tenter.

The fabric thus desized and bleached has the following properties:

| | |
|---|---|
| Reflectance | 80.3% |
| Starch content | 0 |
| Hydrophilicity | Instantaneous |

It will be appreciated from the foregoing disclosure by those skilled in the art that the quantity of alkali metal chlorite (based on 100 percent) in the bath can range from 5 to 40 g/L; the activator, from 1 to 30 g/L; the enzyme, from 5 to 30 g/L; and the surface active agent solution can range from 0.5 to 2 mL/L.

What is claimed is:

1. A process for desizing and bleaching cellulosic fabrics in a single operation, which process comprises impregnating cellulosic cloth with a aqueous desizing-bleaching composition having a pH of at least 9.2 and containing alkali-metal chlorite, a surface active agent, an activator, an amolytic enzyme, and a strong alkali-metal hydroxide base.

2. A process according to claim 1 wherein the pH of the desizing-bleaching composition is from 9.2 to 9.5.

3. A process according to claim 1 wherein the temperature is from 20° to 120° C.

4. A process according to claim 3 wherein the fabric is steamed to provide the temperature.

5. A process according to claim 1 wherein the time of treatment is from five minutes to four hours.

6. A process according to claim 1 wherein the chlorite is sodium chlorite and the hydroxide is sodium hydroxide.

7. A process according to claim 1 wherein the cloth is impregnated with the desizing-bleaching composition and the impregnated cloth is then squeezed to provide an amount of composition in the cloth of from about 60 to about 120 percent of the weight of the fabric.

* * * * *